US006807682B1

(12) United States Patent
Shircliff

(10) Patent No.: US 6,807,682 B1
(45) Date of Patent: Oct. 26, 2004

(54) KNEEPAD ASSEMBLY

(76) Inventor: David E. Shircliff, 7601 Michael Dr., Louisville, KY (US) 70228

( * ) Notice: Subject to any disclaimer, the term of this patent is extended or adjusted under 35 U.S.C. 154(b) by 334 days.

(21) Appl. No.: 10/108,050

(22) Filed: Mar. 28, 2002

(51) Int. Cl.[7] ..... A41D 13/06
(52) U.S. Cl. ..... 2/24; 2/62; 602/26
(58) Field of Search ..... 2/24, 16, 455, 2/62, 267, 23, 59, 46, 69, 908, 911; 128/878, 882, 892; 602/16, 20, 23–26, 62, 63; D24/190; D29/120.1, 121.1

(56) References Cited

U.S. PATENT DOCUMENTS 573,919 A * 12/1896 Rice ..... 2/24
909,215 A * 1/1909 Pierce et al. ..... 2/22
1,293,240 A * 2/1919 Summers ..... 2/24
1,560,825 A * 11/1925 Kelticka ..... 2/24
1,753,055 A * 4/1930 Matheson ..... 2/24
1,785,213 A * 12/1930 Shotwell ..... 2/24
2,640,989 A * 6/1953 Woodward ..... 2/22
4,642,814 A * 2/1987 Godfrey ..... 2/462
5,031,240 A * 7/1991 Nierhaus ..... 2/24
5,269,322 A * 12/1993 Mandel ..... 128/845
5,297,294 A * 3/1994 Washick ..... 2/22
5,594,954 A * 1/1997 Huang ..... 2/24
D408,596 S * 4/1999 Dancyger ..... D29/121.1

* cited by examiner

*Primary Examiner*—Tejash Patel
(74) *Attorney, Agent, or Firm*—Joseph N. Breaux

(57) ABSTRACT

A knee pad assembly for protecting a knee of a worker installing tile, wood floors, etc. The knee pad assembly includes an outer knee pad structure, a knee cap support spring, and a resilient foam inner knee and shin pad structure.

3 Claims, 5 Drawing Sheets

FIG.1
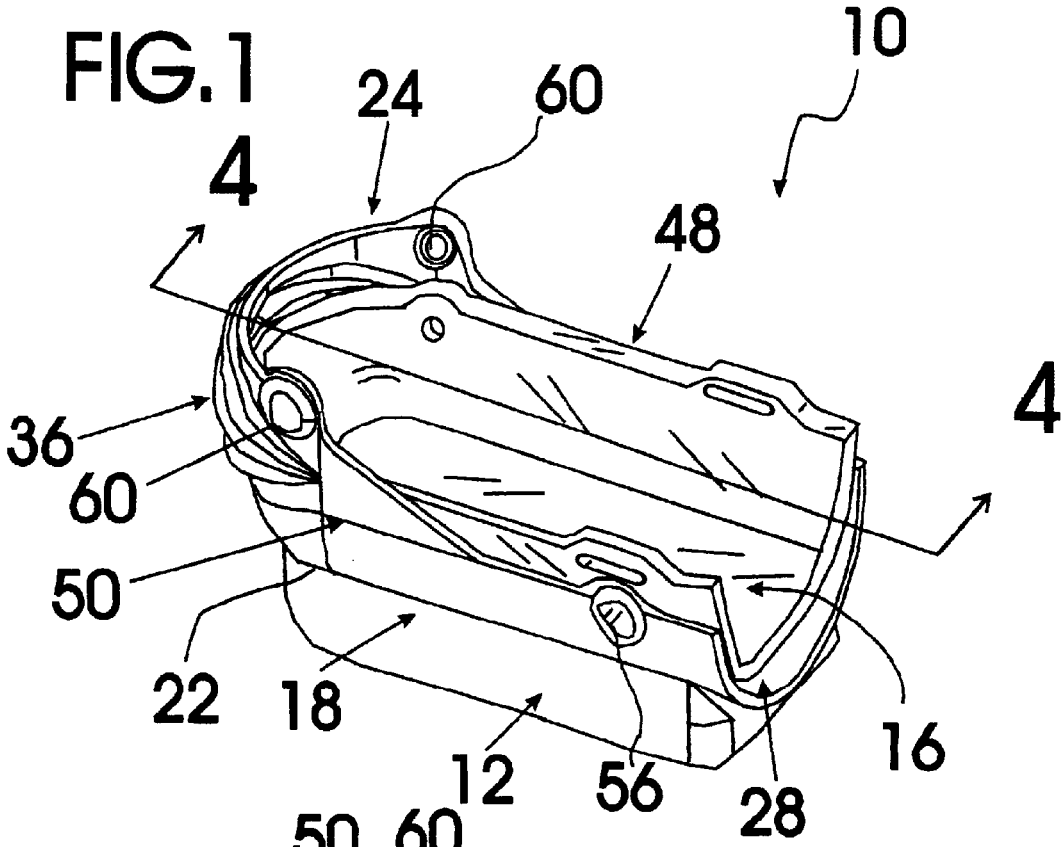
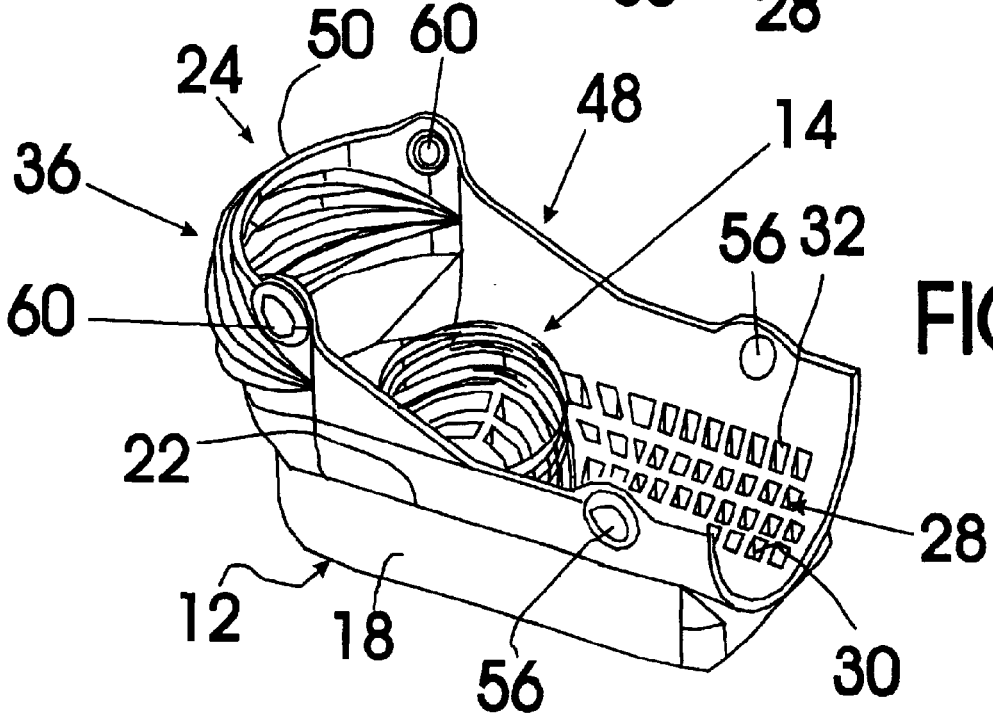
FIG.2

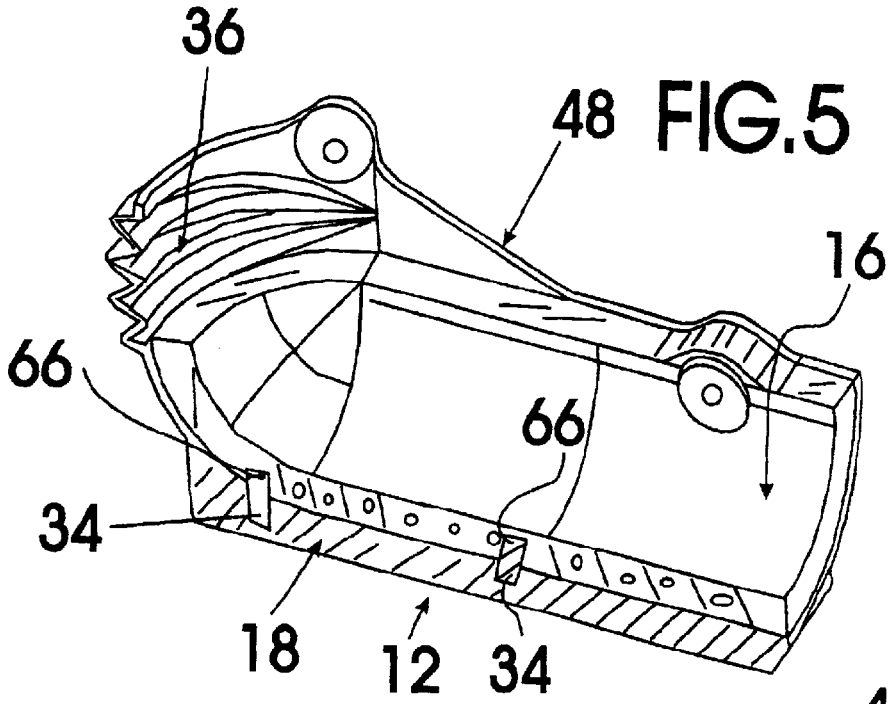
FIG.5
FIG.6
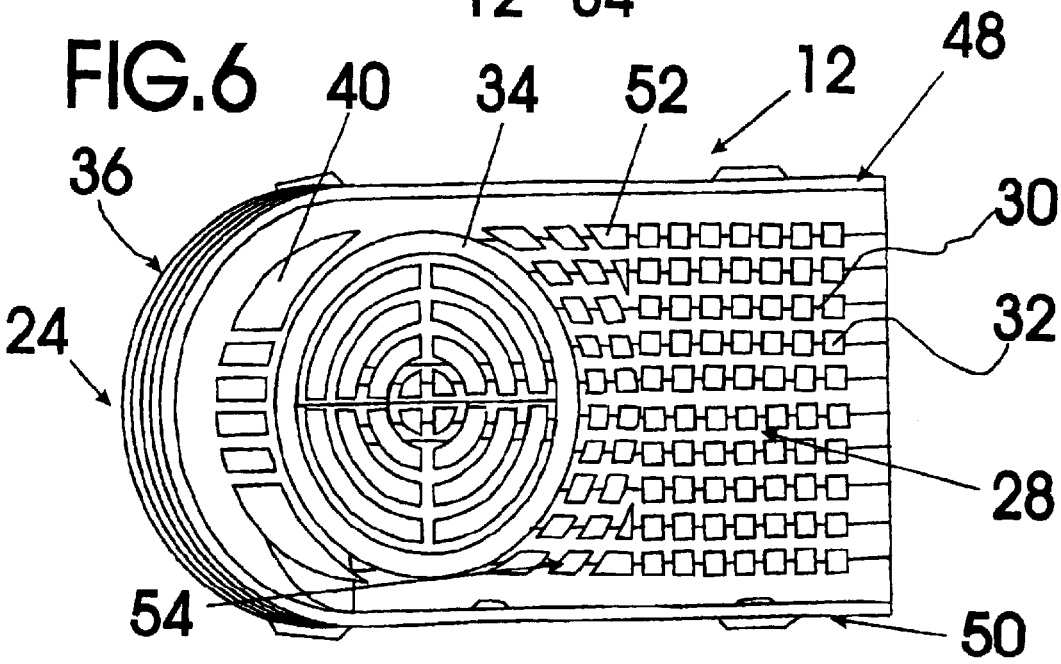

KNEEPAD ASSEMBLY

TECHNICAL FIELD

The present invention relates to workmen's equipment and more particularly to a knee pad assembly for protecting the knee of a worker that includes an outer knee pad structure, a knee cap support spring, and a resilient foam inner knee and shin pad structure; the outer knee pad structure being molded of plastic and including a bottom knee support plate having a non-slip bottom surface and a top portion integrally formed with a knee and shin receiving structure that defines an inner knee and shin pad receiving channel; the inner knee and shin pad receiving channel being partially defined by a bottom channel surface of the knee and shin receiving structure having a number of impact absorbing cavities and a spring bottom receiving channel; the inner knee and shin pad receiving channel being further partially defined by an accordion fold portion extending upwardly from a front end of the bottom channel surface; the inner knee and shin pad receiving channel being still further partially defined by a pair of mirror image side wall assemblies each extending from an opposite side edge of the bottom channel surface and including along a rear top sidewall edge thereof a kneepad assembly retaining strap aperture for receiving a securing strap for retaining the rear portion of the outer knee pad structure adjacent to an upper shin of a user; the accordion fold portion including two spaced retaining strap apertures, each of the two spaced retaining strap apertures being provided for receiving a retaining strap for retaining the accordion fold portion of the outer knee pad structure adjacent to a knee of a user; the resilient foam inner knee and shin pad structure being shaped to seat into the inner knee and shin pad receiving channel of the knee and shin receiving structure and including a top spring receiving channel for receiving a top end of the knee cap support spring when the bottom end of the knee cap support spring is positioned within the spring bottom receiving channel of the bottom channel surface.

BACKGROUND OF INVENTION

Many individuals who work installing tile, wood flooring, etc. have to spend a considerable amount of time on one or more knees in order to accomplish the work this can lead to knee pain as well as knee injury. It would be a benefit to these individuals to have one or more knee pad assemblies that could be attached, respectively, to one or more knees as needed for reducing the wear and tear on the knees.

GENERAL SUMMARY DISCUSSION OF INVENTION

It is thus an object of the invention to provide kneepad assembly that includes an outer knee pad structure, a knee cap support spring, and a resilient foam inner knee and shin pad structure; the outer knee pad structure being molded of plastic and including a bottom knee support plate having a non-slip bottom surface and a top portion integrally formed with a knee and shin receiving structure that defines an inner knee and shin pad receiving channel; the inner knee and shin pad receiving channel being partially defined by a bottom channel surface of the knee and shin receiving structure having a number of impact absorbing cavities and a spring bottom receiving channel; the inner knee and shin pad receiving channel being further partially defined by an accordion fold portion extending upwardly from a front end of the bottom channel surface; the inner knee and shin pad receiving channel being still further partially defined by a pair of mirror image side wall assemblies each extending from an opposite side edge of the bottom channel surface and including along a rear top sidewall edge thereof a kneepad assembly retaining strap aperture for receiving a securing strap for retaining the rear portion of the outer knee pad structure adjacent to an upper shin of a user; the accordion fold portion including two spaced retaining strap apertures, each of the two spaced retaining strap apertures being provided for receiving a retaining strap for retaining the accordion fold portion of the outer knee pad structure adjacent to a knee of a user; the resilient foam inner knee and shin pad structure being shaped to seat into the inner knee and shin pad receiving channel of the knee and shin receiving structure and including a top spring receiving channel for receiving a top end of the knee cap support spring when the bottom end of the knee cap support spring is positioned within the spring bottom receiving channel of the bottom channel surface.

Accordingly, a kneepad assembly is provided. The kneepad assembly includes an outer knee pad structure, a knee cap support spring, and a resilient foam inner knee and shin pad structure; the outer knee pad structure being molded of plastic and including a bottom knee support plate having a non-slip bottom surface and a top portion integrally formed with a knee and shin receiving structure that defines an inner knee and shin pad receiving channel; the inner knee and shin pad receiving channel being partially defined by a bottom channel surface of the knee and shin receiving structure having a number of impact absorbing cavities and a spring bottom receiving channel; the inner knee and shin pad receiving channel being further partially defined by an accordion fold portion extending upwardly from a front end of the bottom channel surface; the inner knee and shin pad receiving channel being still further partially defined by a pair of mirror image side wall assemblies each extending from an opposite side edge of the bottom channel surface and including along a rear top sidewall edge thereof a kneepad assembly retaining strap aperture for receiving a securing strap for retaining the rear portion of the outer knee pad structure adjacent to an upper shin of a user; the accordion fold portion including two spaced retaining strap apertures, each of the two spaced retaining strap apertures being provided for receiving a retaining strap for retaining the accordion fold portion of the outer knee pad structure adjacent to a knee of a user; the resilient foam inner knee and shin pad structure being shaped to seat into the inner knee and shin pad receiving channel of the knee and shin receiving structure and including a top spring receiving channel for receiving a top end of the knee cap support spring when the bottom end of the knee cap support spring is positioned within the spring bottom receiving channel of the bottom channel surface.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 1 is a perspective view of an exemplary embodiment of the knee pad assembly of the present invention showing the outer knee pad structure and the resilient foam inner knee pad structure.

FIG. 2 is a perspective view of the exemplary embodiment of the knee pad assembly of FIG. 1 with the resilient foam inner knee pad structure removed to show the knee cap support spring of the knee pad assembly of FIG. 1.

FIG. 5 is a second cross-sectional view of the exemplary embodiment of the knee pad assembly of FIG. 1 configured for use without the knee cap support spring.

FIG. 6 is a top plan view of the outer knee pad structure of the exemplary embodiment of the knee pad assembly of FIG. 1 in isolation.

EXEMPLARY EMBODIMENTS

Figure 3:
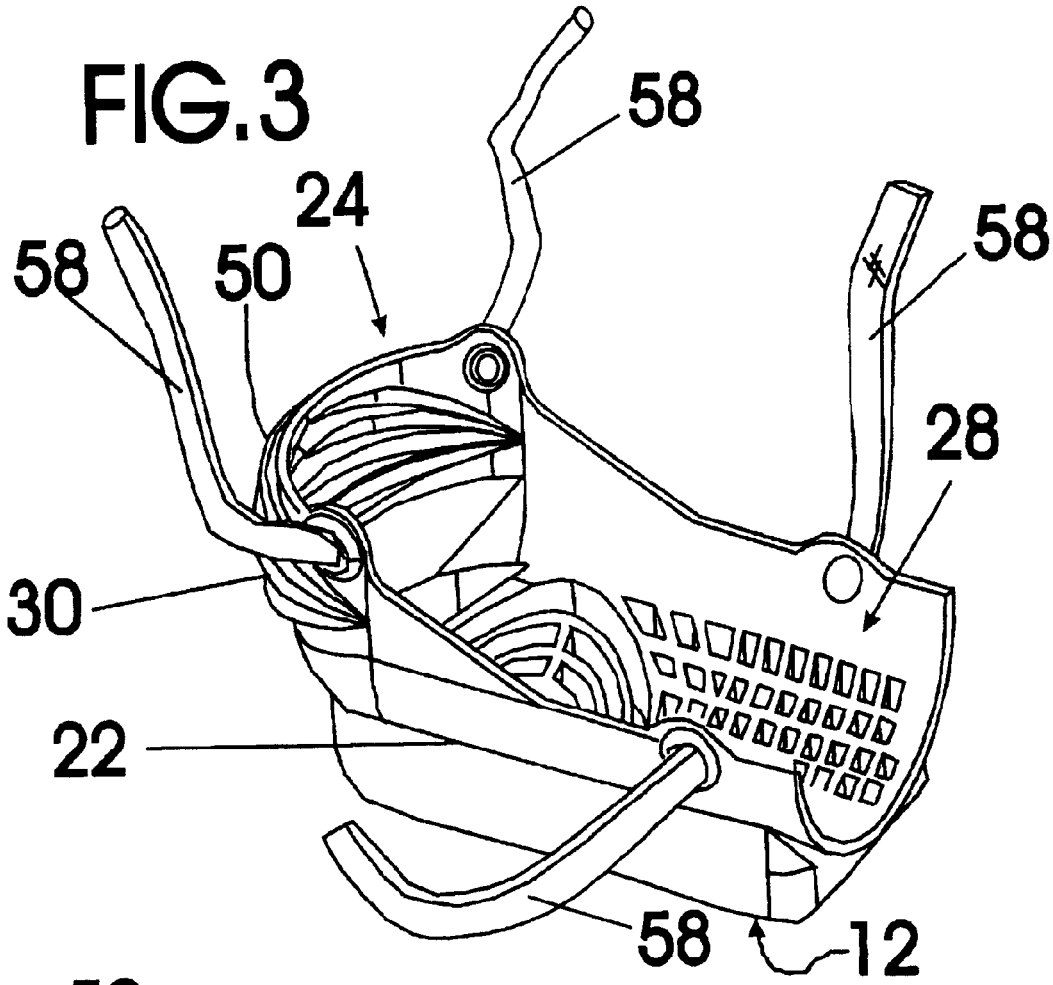
FIG. 3 is a perspective view of the outer knee pad structure of the exemplary embodiment of the knee pad assembly of FIG. 1 in isolation; also show are two representative securing straps.
Figure 4:
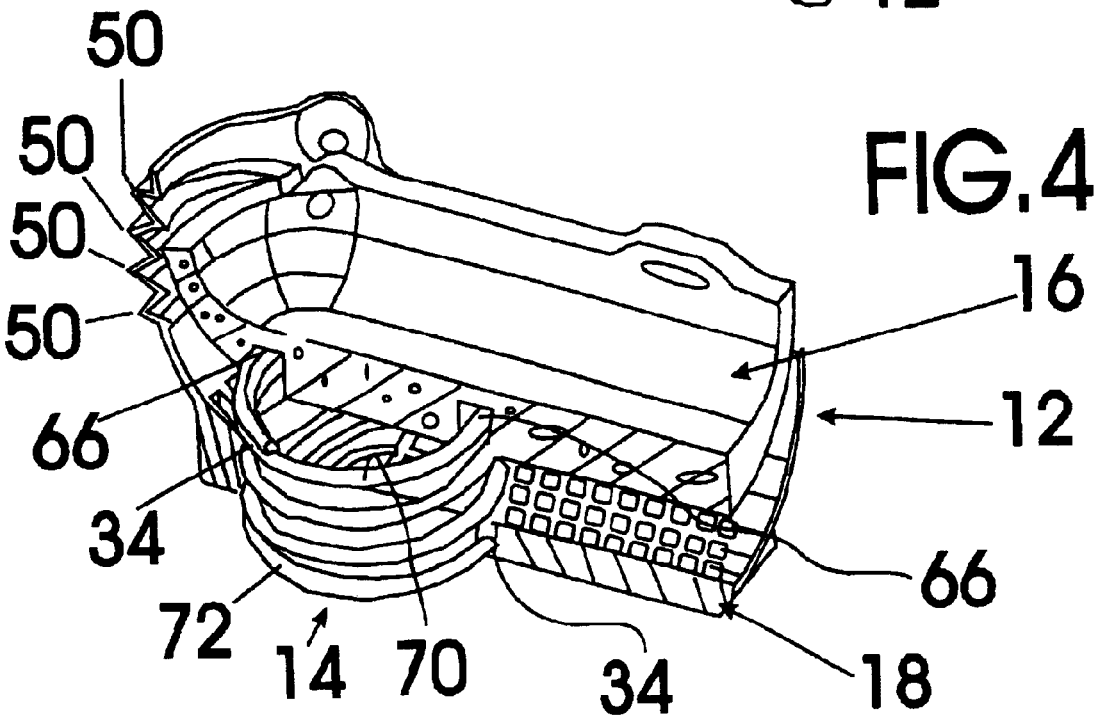
FIG. 4 is a cross-sectional view of the exemplary embodiment of the knee pad assembly along the line 4—4 of FIG. 1 show is a perspective view of an exemplary embodiment of the knee pad assembly of the present invention showing the outer knee pad structure, the knee cap support spring, and the resilient foam inner knee pad structure.
Figure 7:
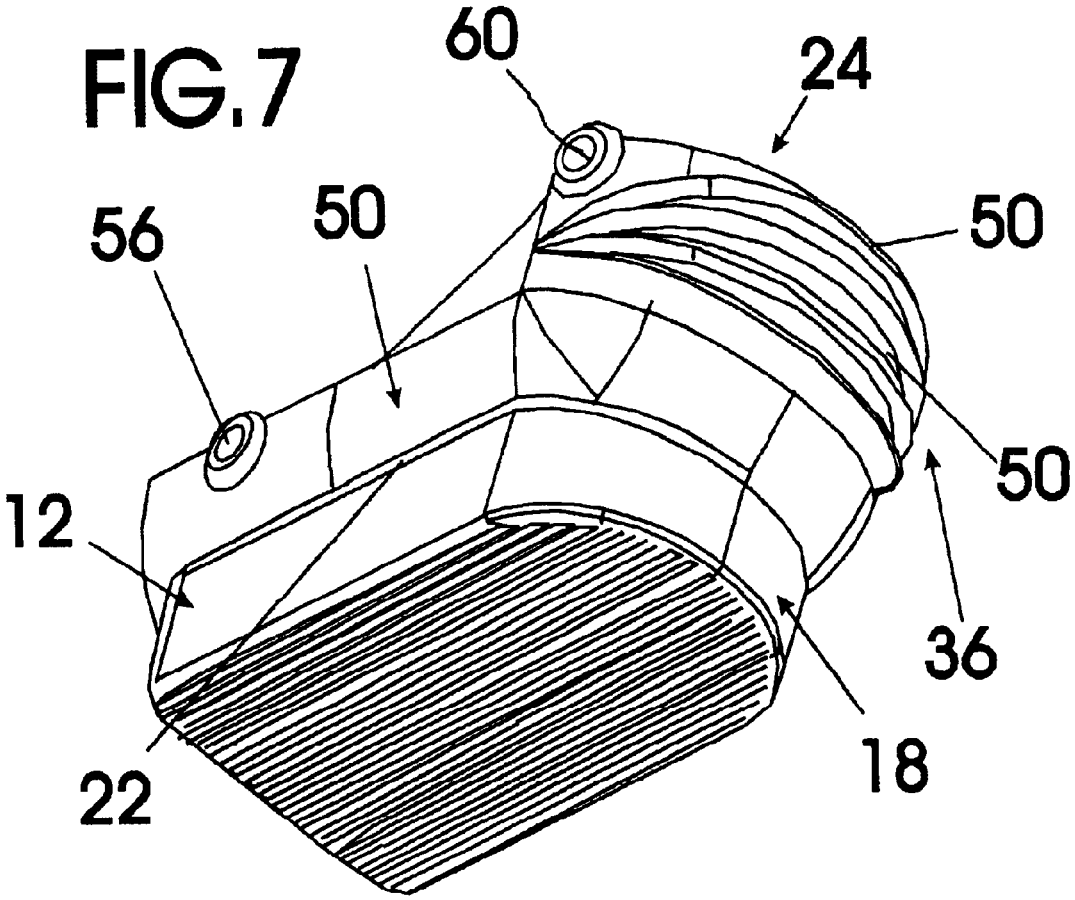
FIG. 7 is an underside perspective view of the outer knee pad structure of the exemplary embodiment of the knee pad assembly of FIG. 1 in isolation.
Figure 8:
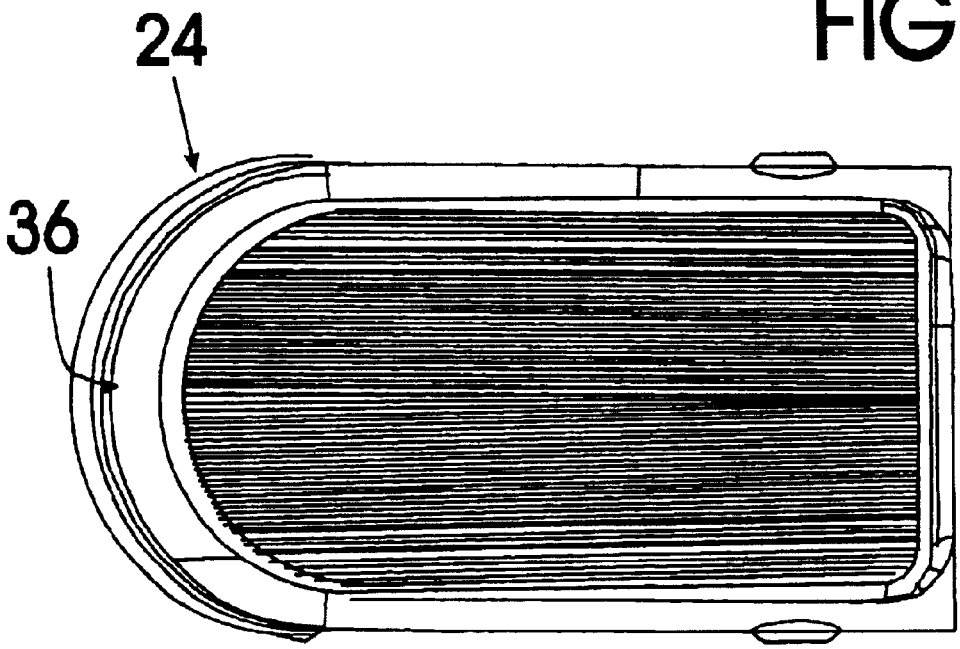
FIG. 8 is a perspective underside view of the outer knee pad structure of the exemplary embodiment of the knee.pad assembly of FIG. 1 in isolation showing the non-slip bottom surface.

FIGS. 1–8 show various aspects of an exemplary embodiment of the kneepad assembly of the present invention generally designated 10. Kneepad assembly knee pad system 10 includes an outer knee pad structure, generally designated 12; a knee cap support spring, generally designated 14; and a resilient foam inner knee and shin pad structure, generally designated 16.

Outer knee pad structure 12 being molded of plastic and including a bottom knee support plate, generally designated 18, having a non-slip bottom surface 20 and a top portion 22 integrally formed with a knee and shin receiving structure, generally designated 24, that defines an inner knee and shin pad receiving channel 28. Inner knee and shin pad receiving channel 28 is partially defined by a bottom channel surface 30 of knee and shin receiving structure 24 that has a number of impact absorbing cavities 32 and a spring bottom receiving channel 34 provided therein. Inner knee and shin pad receiving channel 28 is also partially defined by an accordion fold portion, generally designated 36 extending upwardly from a front end 40 of the bottom channel surface 30 and a pair of mirror image side wall assemblies, generally designated 48, 50 each extending from an opposite side edge 52, 54 of bottom channel surface 30 and each including along a rear top sidewall edge thereof a kneepad assembly retaining strap aperture 56 for receiving a securing strap 58 for retaining the rear portion of outer knee pad structure 12 adjacent to an upper shin of a user.

The accordion fold portion 36 includes a number of semi-circular accordion folds 51 and two spaced retaining strap apertures 60. Each of the two spaced retaining strap apertures 60 is provided for receiving a retaining strap 58 for retaining the accordion fold portion 36 of outer knee pad structure 12 adjacent to a knee of a user.

The resilient foam inner knee and shin pad structure 16 is shaped to seat into the inner knee and shin pad receiving channel 28 of the knee and shin receiving structure 12 and includes a top spring receiving channel 66 for receiving a top end 70 of knee cap support spring 14 when a bottom end 72 of knee cap support spring 14 is positioned within spring bottom receiving channel 34 of bottom channel surface 30.

Figure 9:
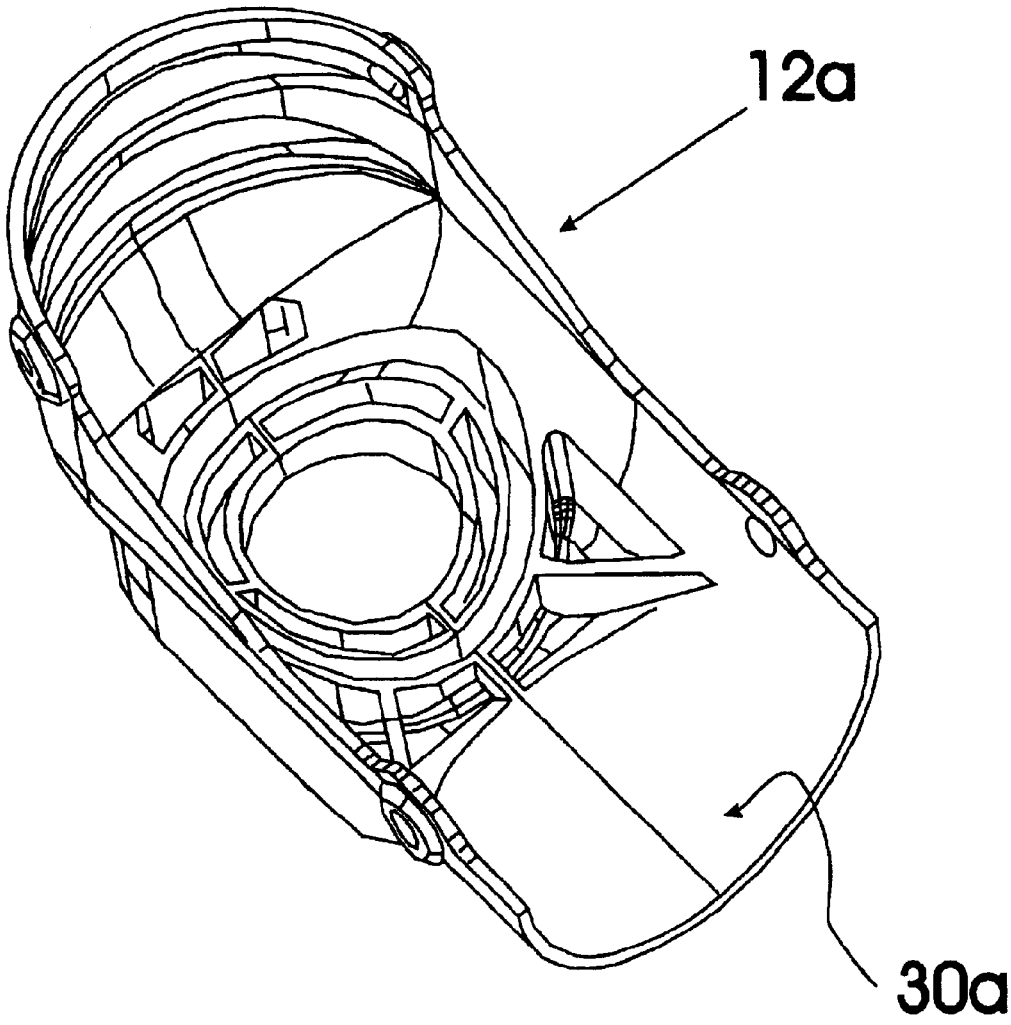
FIG. 9 is a perspective view of a second exemplary embodiment of the outer knee pad structure of the knee pad assembly of the present invention showing a smooth bottom channel surface without any impact absorbing cavities.

FIG. 9 shows a second exemplary embodiment of the outer knee pad structure, generally designated 12*a*, that has a smooth bottom channel surface 30*a* that does not have the impact absorbing cavities 32 of outer knee pad structure 12.

In use, the user may use knee pad assembly 10 with or without knee cap support spring 14 or resilient foam inner knee and shin pad structure 16. Knee cap support spring 14 may be used alone with outer knee pad structure 12 or 12*a*. Also, if desired, resilient foam inner knee and shin pad structure 16 may be used alone with outer knee pad structure 12 or 12*a* by directly inserting resilient foam inner knee and shin pad structure 16 into inner knee and shin pad receiving channel 28 without any knee cap support spring 14. Additionally, two knee pad assemblies 10 may be used, one for each knee of the worker.

It is noted that the embodiment of the kneepad assembly knee pads system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A kneepad assembly comprising:

an outer knee pad structure molded of plastic and including a bottom knee support plate having a non-slip bottom surface and a top portion integrally formed with a knee and shin receiving structure that defines an inner knee and shin pad receiving channel;

the inner knee and shin pad receiving channel being partially defined by a bottom channel surface of the knee and shin receiving structure;

the inner knee and shin pad receiving channel being further partially defined by an accordion fold portion extending upwardly from a front end of the bottom channel surface;

the inner knee and shin pad receiving channel being still further partially defined by a pair of mirror image side wall assemblies each extending from an opposite side edge of the bottom channel surface and including along a rear top sidewall edge thereof a kneepad assembly retaining strap aperture for receiving a securing strap for retaining the rear portion of the outer knee pad structure adjacent to an upper shin of a user;

the accordion fold portion including two spaced retaining strap apertures, each of the two spaced retaining strap apertures being provided for receiving a retaining strap for retaining the accordion fold portion of the outer knee pad structure adjacent to a knee of a user wherein the bottom channel surface includes a spring bottom receiving channel defined therein; and wherein the kneepad assembly further comprises:

a knee cap support spring having a spring bottom sized and shaped to seat into the spring bottom receiving channel.

2. The kneepad assembly of claim 1 further comprising:

a resilient foam inner knee and shin pad structure shaped to seat into the inner knee and shin pad receiving channel of the knee and shin receiving structure.

3. A kneepad assembly comprising:

an outer knee pad structure;

a knee cap support spring; and a resilient foam inner knee and shin pad structure;

the outer knee pad structure being molded of plastic and including a bottom knee support plate having a non-slip bottom surface and a top portion integrally formed with a knee and shin receiving structure that defines an inner knee and shin pad receiving channel;

the inner knee and shin pad receiving channel being partially defined by a bottom channel surface of the knee and shin receiving structure;

the inner knee and shin pad receiving channel being further partially defined by an accordion fold portion extending upwardly from a front end of the bottom channel surface;

the inner knee and shin pad receiving channel being still further partially defined by a pair of mirror image side wall assemblies each extending from an opposite side edge of the bottom a channel surface and including along a rear top sidewall edge thereof a kneepad assembly retaining strap aperture for receiving a securing strap for retaining the rear portion of the outer knee pad structure adjacent to an upper shin of a user;

the accordion fold portion including two spaced retaining strap apertures, each of the two spaced retaining strap apertures being provided for receiving a retaining strap for retaining the accordion fold portion of the outer knee pad structure adjacent to a knee of a user;

the resilient foam inner knee and shin pad structure being shaped to seat into the inner knee and shin pad receiving channel of the knee and shin receiving structure and including a top spring receiving channel for receiving a top end of the knee cap support spring when a bottom end of the knee cap support spring is positioned within a spring bottom receiving channel of the bottom channel surface.

* * * * *